United States Patent [19]

Sviatoslavsky et al.

[11] 4,390,114

[45] Jun. 28, 1983

[54] HINGE CONSTRUCTION FOR ELECTRICAL ENCLOSURES

[75] Inventors: Nicolas N. Sviatoslavsky, Greendale; Charles A. Kelpin, South Milwaukee, both of Wis.

[73] Assignee: Appleton Electric Company, Chicago, Ill.

[21] Appl. No.: 321,806

[22] Filed: Nov. 16, 1981

[51] Int. Cl.[3] ..... B65D 93/14; B65D 51/04

[52] U.S. Cl. ..... 220/337; 362/260; 362/275

[58] Field of Search ..... 220/3.8, 337, 331, 343; 362/260, 275

[56] References Cited

U.S. PATENT DOCUMENTS

| | | | |
|---|---|---|---|
| 3,365,094 | 1/1968 | Palson | 220/337 |
| 3,387,737 | 6/1968 | Baldwin et al. | 220/337 |
| 3,451,580 | 6/1969 | Husky | 220/337 |
| 3,991,905 | 11/1976 | Niopon | 220/343 |

*Primary Examiner*—George T. Hall
*Attorney, Agent, or Firm*—Jon L. Liljequist

[57] ABSTRACT

A hinge construction particularly for pivotally connecting the housing and cover of an electrical enclosure together is preferably formed integrally as part of the lid and as part of the housing so as not to require separate fasteners or hinge pins, yet the hinge portions on both housing and cover are formed in a straight-draw die casting operation not requiring side cores. The housing includes two outwardly extending appendages, each carrying a laterally extending pin cantilevered in the same direction as the other pin and axially aligned therewith. One pin at its outer end carries an obstruction jutting transversely outwardly therefrom in a predetermined angular orientation. Hinge portions on the cover also include appendages, but in the form of a pair of outwardly lugs with a laterally extending hole in each which is axially aligned with the hole in the other lug. The hole in one of these lugs is of the same profile shape as the obstruction on the one hinge pin so that the cover can be slipped sideways over both pins simultaneously, but only when the cover is at a predetermined angle relative to the housing.

5 Claims, 7 Drawing Figures

HINGE CONSTRUCTION FOR ELECTRICAL ENCLOSURES

TECHNICAL FIELD

This invention relates broadly to the construction of rigid electrical enclosures, and more specifically it relates to a hinge construction for electrical enclosures that is easily and inexpensively produced from simple tooling.

BACKGROUND OF THE INVENTION

Electrical enclosure hinges that are integrally cast at least in part onto the cover and housing are shown in U.S. Pat. No. 3,991,905 to John E. Nicpon of Chicago, Ill. That patent discloses a top-hinged cover for an outdoor lamp where the hinge is integrally cast as part of the housing and cover and comprises two "U" shaped extensions on the cover as well as four on the housing. This already known construction, however, does require separate hinge pins, and those hinge pins pivotally lock the cover to the housing to prevent its removal therefrom. Routine servicing of such devices may include replacing parts, and in the cast of a lamp case, cleaning the glass lens in the cover. Because an outdoor lamp is usually mounted in an elevated and stationary position, this operation is frequently done from a ladder or elevated platform. Under certain conditions, such as when weather or lighting conditions are poor, it would be desirable to be able to remove the cover from the housing so that the cleaning of the glass lens could be carried on in a more favorable environment. Normally an additional capability such as that of being able to remove the cover from the housing would require a more expensive construction than the Nicpon construction mentioned above.

SUMMARY OF THE INVENTION

The hinge construction of the present disclosure permits an electrical housing and cover to be pivotally connected, yet remain readily separable by a simple manipulation without tools. All portions of the hinge including the hinge pins are integrally cast onto the housing and cover and require no machining or other operations to render them operable as a hinge. Those hinge portions forming a part of the cover have holes oriented transversally therethrough (relative to the direction of opening the die or mold that forms them), yet these holes are produced with a straight-draw die without side cores. Those two portions of the hinge that are cast integrally with the housing each include a laterally extending hinge pin. These two hinge pins are in axial alignment with one another, and each is cantilevered in axial alignment with and in the same direction as the other pin. Thus, if no further structure were present, proper positioning of the cover relative to the housing such that the holes in the cover lugs lie adjacent the distal ends of the hinge pins would permit the cover to be shifted laterally so as to cause the pins and lugs to mate whereby the cover becomes pivotally mounted on the housing.

However, this would permit the cover to be removed from the housing by reversing this movement no matter what angle the cover happened to make with the housing. This, it will be understood, would be undesirable because the cover might be inadvertently knocked off of the housing and dropped.

To avoid this possibility, one of the hinge pins on the housing and its mating lug on the cover carry cooperating and interfitting structure that prevents assembly of the cover onto the base, as well as disassembly therefrom, unless the cover is oriented at a predetermined and specific angle relative to the base. This "release angle" is intermediate the limits of the covers swing to thus substantially eliminate the possibility of the cover being inadvertently removed.

To this end one hinge pin on the housing has a cam-like lobe cast on its outermost end, and the hole with which it mates on the cover is formed of a similar shape. The cover will thus assemble onto the housing only when the cover and housing are at such an angle that the profile of the lobe and its mating hole are aligned. Similarly, the cover can only be removed from the housing when the two are again at that same predetermined angle. This greatly reduces the possibility of dropping a cover, yet when desired, the cover can be removed easily for servicing. And, as will be seen in greater detail later, all of this structure is achieved in two simple die casting operations (one for the cover and one for the housing) where the core and and cavity of each draw straight without side coring.

DESCRIPTION OF PREFERRED EMBODIMENT

Figure 1:
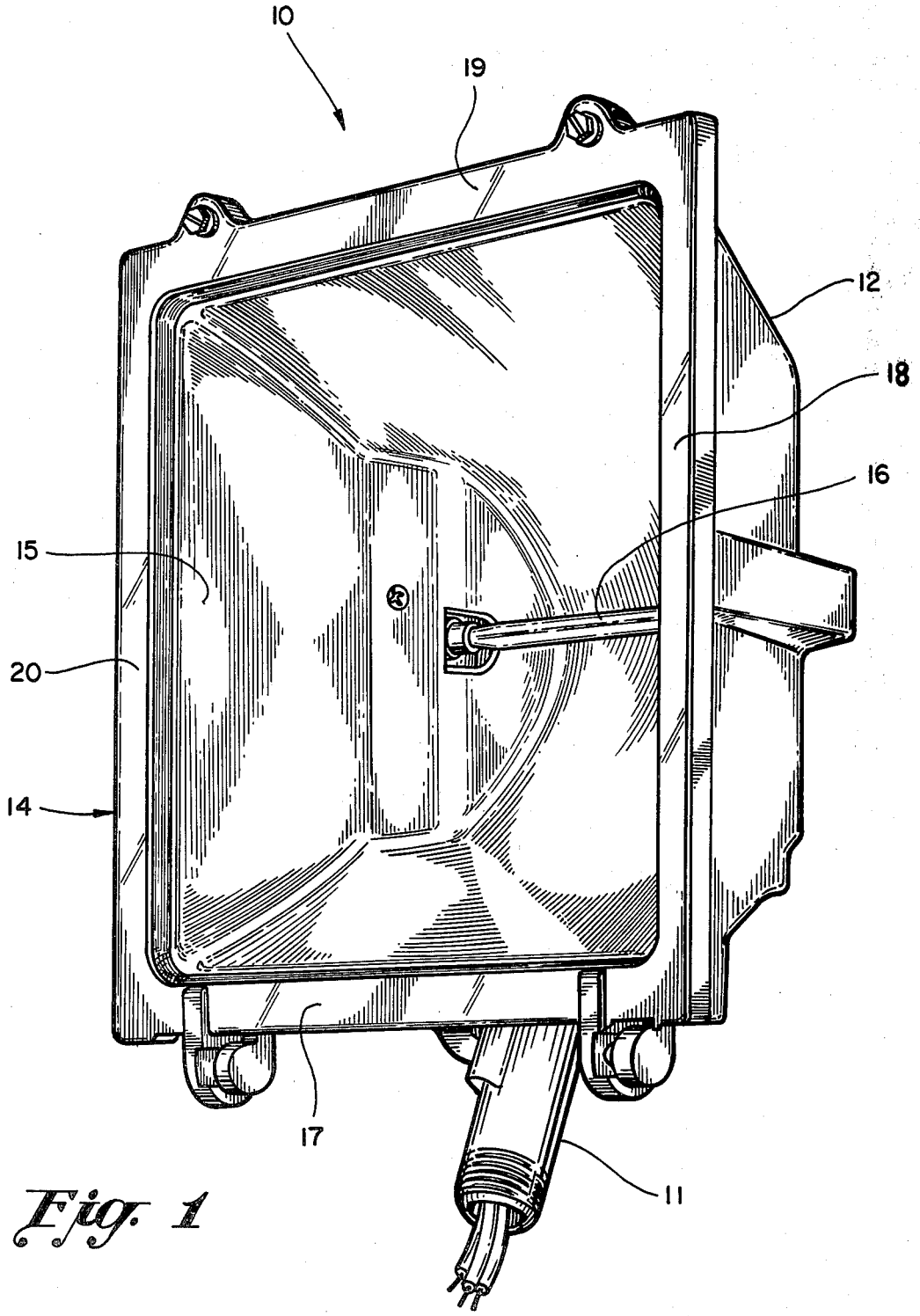
FIG. 1 is a perspective view of a complete, outdoor lighting fixture embodying the principals of the present invention.

Referring now to the Figures, and initially to FIG. 1, there is shown an electrical enclosure in the form of a lamp case designated generally 10 mounted on a pivotable bracket 11 threaded at its lower end for connection to conduit or the like. Lamp case 10 includes a concave housing 12 and a cover 14 which extends across the housing's frontal and otherwise open surface. Housing 12 is cast or molded, preferably die cast, and it may contain a variety of electrical paraphernalia. In this particular application it contains a reflector 15, a lamp 16 and various other structures. Cover 14 includes a preferably die cast and square shaped rim or frame consisting of four edge portions 17–20 which support therebetween a pane of transparent glass.

As mentioned earlier, the invention relates to the hinge construction that permits cover 14 to be pivotally mounted on housing 12, captivated thereby, yet also permits its removal by a simple manipulation. Additionally, the invention goes to a way of getting this hinge at essentially no extra cost and with no extra parts beyond the housing and cover alone.

Figure 2:
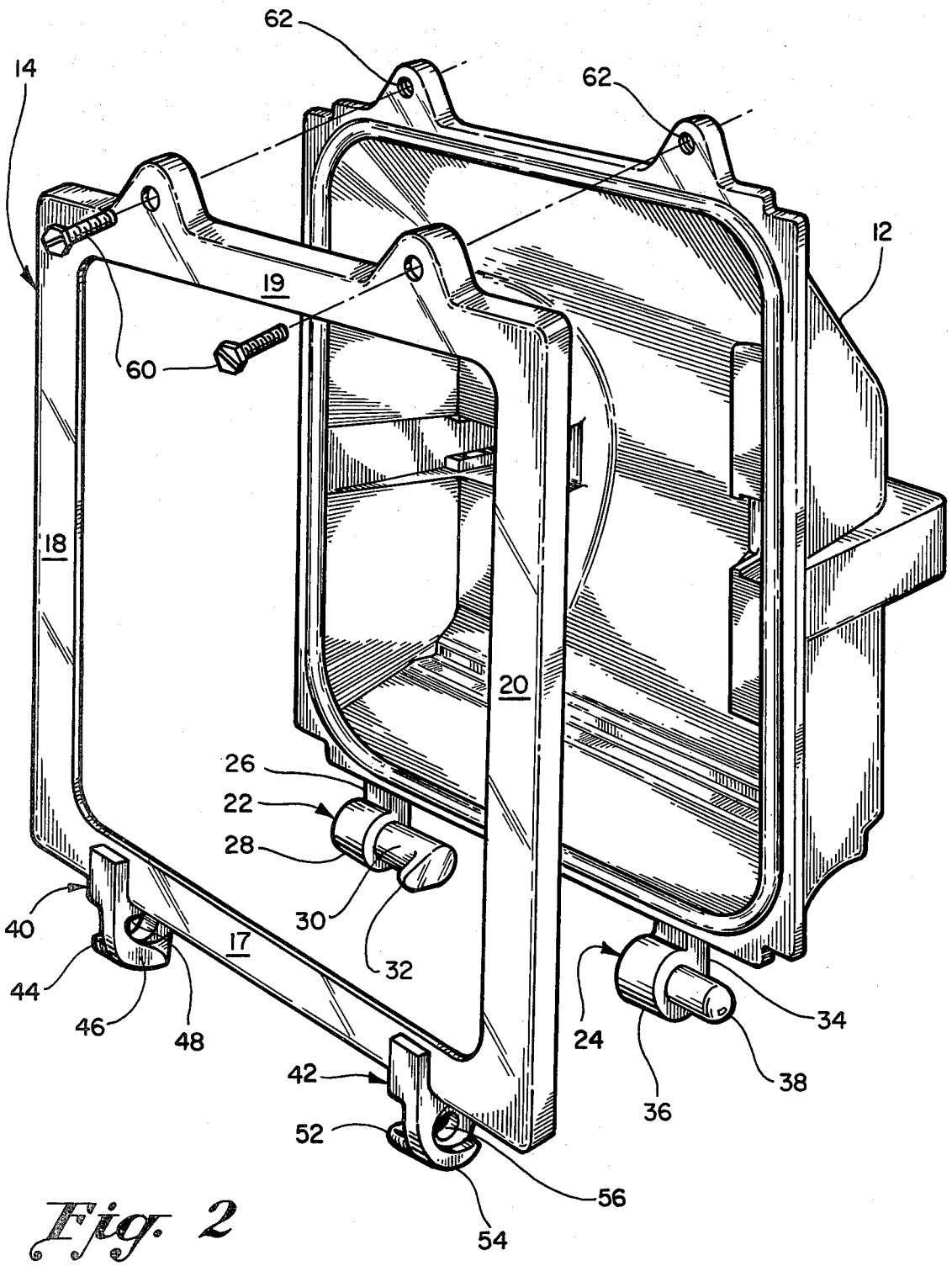
FIG. 2 is an exploded perspective view of only the housing and cover castings of the lighting fixture shown in FIG. 1.

As will perhaps best be understood upon a viewing of FIG. 2, housing 12 includes a pair of appendages at its bottom designated 22 and 24. Appendage 22 includes a downwardly extending leg portion 26 leading to a cylindrical portion 28 having a pin 30 extending laterally outwardly therefrom, the latter including a portion which will herein be termed limited captivation means shown in the form of a tapered cam-like lobe located at the distal end of pin 30. The purpose for these captivation means will be discussed in greater detail later.

Appendage 24 similarly includes a leg portion 34, a cylindrical portion 36 and a pin 38 extending laterally out of cylindrical portion 36. Both pin 30 and pin 36 cantilever away from their respective cylindrical portions in the same direction, and both have longitudinal axes collinear with one another. However, pin 36 need not carry a cam-like lobe at its outer end similar to that of cam 32 on pin 30 because, as will be seen, one such lobe performs equally as well as two. In the design shown, lobe 32 on pin 30 is directed at a small angle (herein 12½ degrees) downwardly from the direction the lamp case 10 faces. This angle will be seen to influence that orientation at which the cover can be removed from the housing (to be described shortly), and it is also influential in achieving a straight-draw casting capability for the cover (also to be described later).

Figure 5:
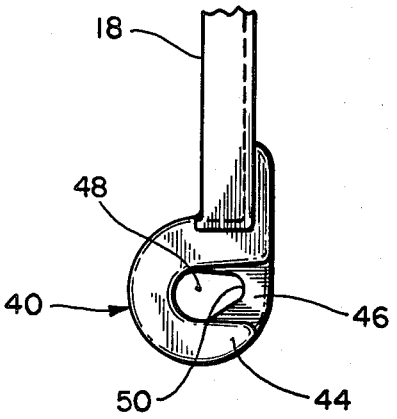
FIG. 5 is a side elevation of the cover portion shown in FIG. 4 as seen from the left.
Figure 4:
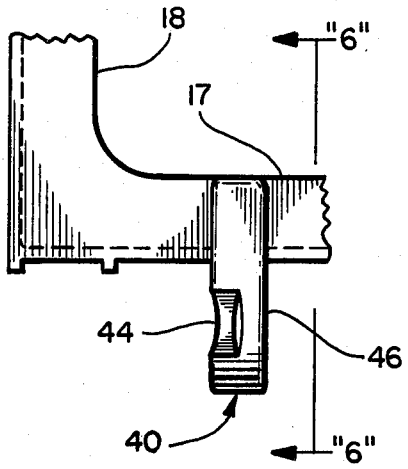
FIG. 4 is a front elevation of the lower left hand corner of the light fixture cover as seen in FIGS. 1 and 2.
Figure 6:
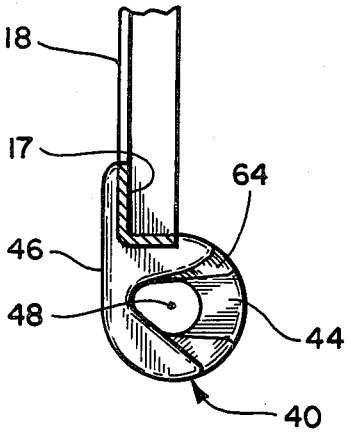
FIG. 6 is a side elevation, partially in cross-section of the cover portion shown in FIG. 4 as seen from the right in FIGS. 1 and 2.

Extending downwardly from cover edge portion 17 of the cover 14 is another pair of appendages 40 and 42. Appendage 40 comprises a strut consisting of a pair of oppositely facing, U-shaped, laterally adjacent portions 44 and 46 which together define a hole 48 therethrough shaped similarly to but slightly larger than the profile of cam 32 on appendage 22 of the housing 12. The lobe end 50 of the hole 48 is directed at a small angle (herein 12½ degrees) forwardly and upwardly from the horizontal when cover edges 17–20 lie in a vertical plane (see FIGS. 5 and 6).

Strut 42 also includes two generally U-shaped and laterally adjacent portions 52 and 54 which also face in opposite directions so as to form a circular hole 56 therethrough. Portions 44 and 52 of struts 40 and 42 respectively face forwardly generally at right angles to the plane of cover edges 17–20, while portions 46 and 54 generally face rearwardly at right angles relative to the plane of cover edges 17–20.

Figure 3:
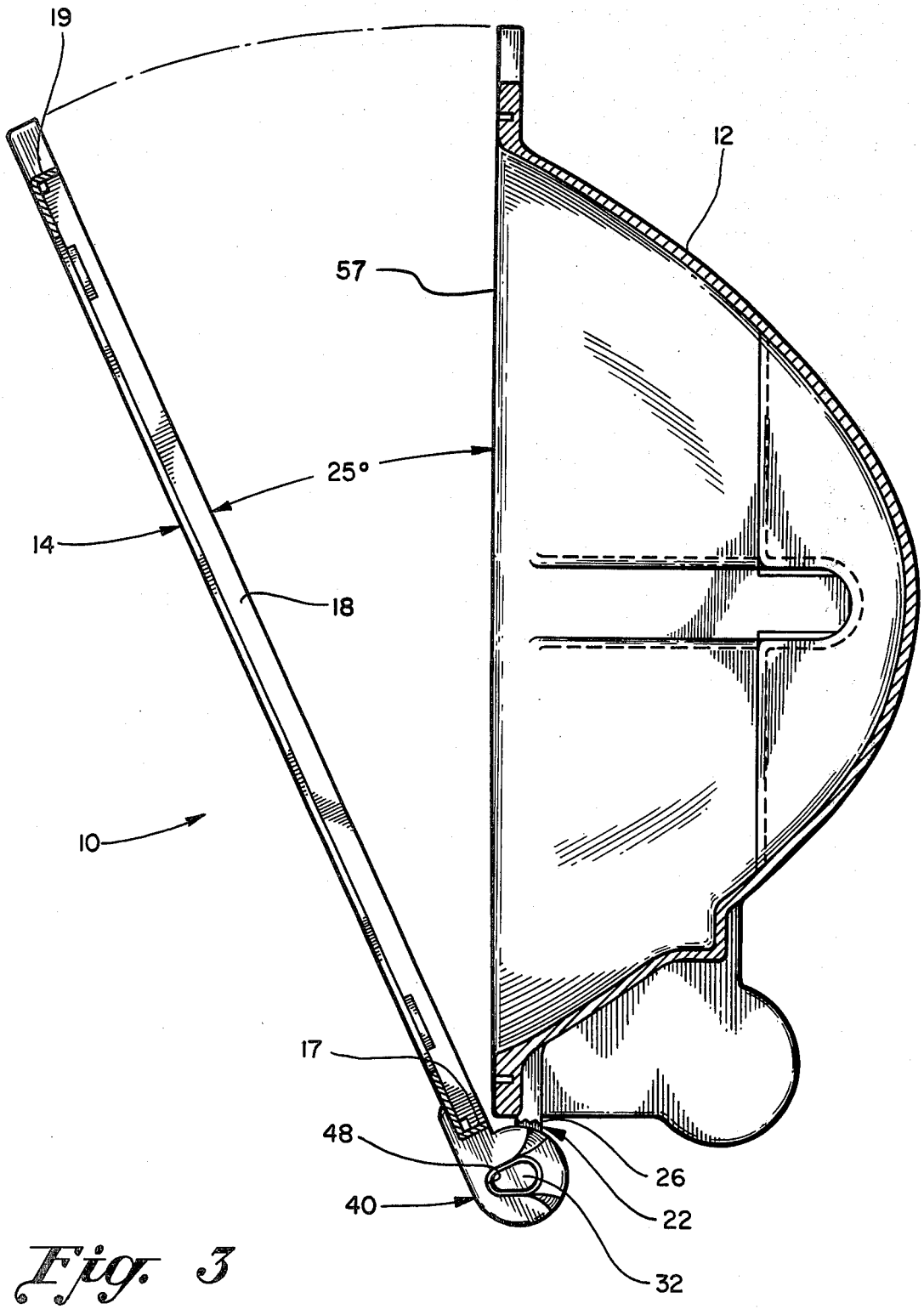
FIG. 3 is a side view in cross-section of the housing of the light fixture, this view also showing the cover in dashed lines at that singular orientation relative to the housing where the cover can be mounted or removed from the housing.

Mounting the cover 14 onto the housing 12 simply involves lining the strut holes 48 and 56 adjacent the distal ends of pins 30 and 38, respectively, and then sliding the cover struts over the pins toward cylindrical portions 28 and 36 of appendages 22 and 24 respectively. As will be understood, pin 38 will readily mate with the hole 56, but the other pin 30 will only mate with hole 48 when the profile of lobe 32 on the pin properly aligns angularly with the profile of hole 48. Referring now specifically to FIG. 3, it will be seen that the 12½ degree orientation of hole 48 combines with the 12½ degree orientation of lobe 32 such that assembly of the cover onto the housing will only occur when the plane of the cover edges 17–20 makes a 25 degree angle relative to the front surface 57 of the housing 12. Similarly the cover must be at that same angle to be removed. Thus, when it is desired to service the interior of the lampcase, cover 14 is first unfastened at the top by loosening several machine screws 60. These screws extend through cover edge portion 19 and engage internally threaded holes 62 in the housing.

Once screws 60 are unfastened, cover 14 can be pivoted forwardly and downwardly away from the housing until it freely hangs from pins 30 and 38. In this position the cover 14 cannot be inadvertently knocked off the housing 12 because the lobe 32 on pin 30 does not align with the lobed end 50 of hole 48. And, in lowering cover 14 from its fastened position to its free hanging position, the servicer is informed to not exert a side thrust thereon particularly when it reaches the 25 degree removal angle. Thus, the cover remains captivated by the housing.

On the other hand, if it is desired to remove the cover 14 entirely, the servicer need merely exert a sideways thrust (to the right in this design as viewed in FIGS. 1 and 2) while he is swinging it open, and the cover will come off when it reaches the 25 degree angle. Obviously, the 25 degree angle is a matter of design choice, and another angle, range of angeles or plurality of angles could also be used.

Another important and related aspect of the invention is that of achieving all of the above without more pieces than that of the housing and cover alone, and also to achieve this construction in a molded or die cast construction where simple straight-draw tooling can be used without the necessity of any side coring. It is further possible to achieve this where the parting line for the housing lies in a flat plane, this feature also holding toling cost down. Specifically, the parting line extends around housing 12 slightly behind its front surface 57, along the front edges of appendage leg portions 26 and 34, and runs around the top and bottom extremities of cylindrical portions 28 and 36 as well as pins 30 and 38. Appropriate draft is present on all surfaces, and the taper of lobe 32 exceeds its 12½ degree orientation so that the entire housing 12 is freely removable from the die in a straight-draw operation. That the lobe 32 does not interfere with opening the mold will be made most clear upon a viewing of the bottom portions of FIG. 3.

Figure 7:
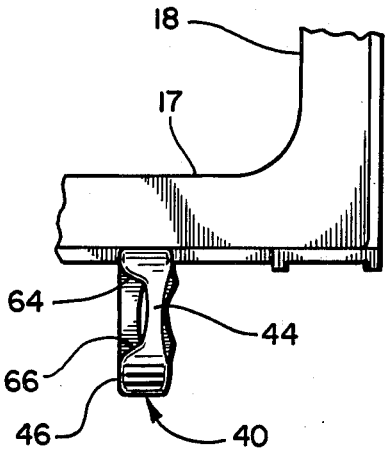
FIG. 7 is a rear elevation of that portion of the cover shown in FIG. 4.

In a like sense, cover 14 is molded or cast in a straight-draw operation with the core and cavity of the die opening forwardly and rearwardly relative to the cover, yet the holes 48 and 56 (which extend transverse of this direction) are readily formed. This will be understood upon a viewing of FIGS. 4–7 where it can be seen by way of representative lug 40 that the hole 48 therethrough is half formed by U-shaped portion 44 and half formed by U-shaped portion 46. The U-shaped opening in portion 44 is formed by that portion of die which opens forwardly of cover 14, and the U-shaped portion 46 is formed by that portion of die that opens rearwardly relative to the cover. As will be understood, when the die is closed, portions of the core and portions of the cavity abut each other at that portion of the interface between portions 44 and 46 that form the hole 48. Thus, when the die is opened, the hole 48 is automatically formed in a straight-draw of the die even though it appears to be, and is, in fact a hole oriented transversely of the direction of the opening of the die. The lobe end 50 of the hole 48 (see FIG. 5) has sides which are tapered at a greater angle than the 12½ degree orientation of the lobe so that there is appropriate draft as the die opens. A pair of tapered camming surfaces 64 and 66 forming a part of strut portion 46 (see FIGS. 6 and 7) keep lobe 32 properly biased laterally so that fasteners 60 align with the threaded holes 62 in the housing except over a small angle including and to each side of that orientation where the cover is attachable and removable from the housing.

Except for the oblated hole 48 and cam surfaces 64 and 66, strut 42 is generally similar to strut 40.

Although the various figures show pins 30 and 38 cast integrally with housing 12 and holes 48 and 56 formed as a part of cover 14, some applications of the invention may reverse this such that the pins are cast onto the cover and the holes are formed in the housing.

The above disclosure is offered for public dissemination in return for the grant of a patent. Although it is detailed to insure adequacy and aid understanding, this is not intended to prejudice that purpose of the patent which is to cover each new and inventive concept contained therein no matter how others may later disguise it by variations in form or additions for further improvements. The true breadth or scope of the invention is to be determined by the language used in the claims herein when given its broadest, reasonable interpretation.

We claim:

1. An improved electrical enclosure, comprising:

a concave housing for containing electrical paraphernalia and a cover therefor, each of said housing and cover having a pair of spaced apart appendages, the pair of appendages on one of said housing and cover each including a pin both in axial alignment with the other pin and also cantilevered outwardly in the same direction as the other pin, the pair of appendages on the other of said housing and cover each including a transverse hole therethrough in axial alignment with the other hole and of a size and shape and so positioned as to permit said pins and holes to matingly assemble together and permit said cover to pivot relative to said housing, and means forming a part of one appendage on the housing and also forming a part of its mating appendage on the cover for captivating the cover and housing together over a substantial portion of the relative pivotal movement between cover and housing and for releasing the cover axially of said pins only over a specific and limited angle between cover and housing.

2. The electrical enclosure of claim 1, wherein said captivation means comprises a cam-shaped lobe on the pin of one appendage and a correspondingly shaped hole in its mating appendage.

3. The electrical enclosure of claim 1 or 2 wherein the pair of appendages on the cover are integrally formed therewith as a single piece.

4. The electrical enclosure of claim 1 or 2 wherein the pair of appendages formed on the housing are integrally formed therewith as a single piece.

5. The electrical enclosure of claim 1, wherein the pair of appendages of which each includes a transverse hole therethrough are both integrally cast with one of said housing and cover in a straight-draw operation, each of said appendages comprising a pair of oppositely facing, adjacent, and generally U-shaped portions.

* * * * *